US007292211B2

(12) United States Patent
Chao et al.

(10) Patent No.: US 7,292,211 B2
(45) Date of Patent: Nov. 6, 2007

(54) LIQUID CRYSTAL DISPLAY AND DRIVING CIRCUIT THEREOF

(75) Inventors: Zuei-Tien Chao, Dajia Township, Taichung County (TW); Hung-Min Shih, Changhua (TW)

(73) Assignee: Au Optronics Corp., Hsinchu (TW)

( * ) Notice: Subject to any disclaimer, the term of this patent is extended or adjusted under 35 U.S.C. 154(b) by 608 days.

(21) Appl. No.: 10/797,219

(22) Filed: Mar. 10, 2004

(65) Prior Publication Data

US 2005/0104825 A1 May 19, 2005

(30) Foreign Application Priority Data

Nov. 14, 2003 (TW) ..... 92132191 A

(51) Int. Cl.
*G09G 3/36* (2006.01)

(52) U.S. Cl. ..... 345/87; 345/88; 345/89; 345/94; 345/98; 345/99; 345/102

(58) Field of Classification Search ..... 345/204–213, 345/98, 94, 14, 102, 629, 690, 87–90, 72, 345/1.1, 3.1, 76, 92, 173, 167, 107, 99; 251/129.04; 362/241

See application file for complete search history.

(56) References Cited

U.S. PATENT DOCUMENTS 5,757,139 A * 5/1998 Forrest et al. ..... 315/169.3
5,778,256 A 7/1998 Darbee ..... 395/892
6,273,394 B1 * 8/2001 Vincent et al. ..... 251/129.04
6,333,750 B1 * 12/2001 Odryna et al. ..... 345/629
6,466,196 B1 * 10/2002 Isogawa et al. ..... 345/102
6,469,454 B1 * 10/2002 Mader et al. ..... 315/291
6,903,716 B2 * 6/2005 Kawabe et al. ..... 345/99
6,961,190 B1 * 11/2005 Tamaoki et al. ..... 359/726
7,113,163 B2 * 9/2006 Nitta et al. ..... 345/102
7,116,301 B2 * 10/2006 Numao ..... 345/89
2002/0057238 A1 * 5/2002 Nitta et al. ..... 345/87
2003/0058235 A1 * 3/2003 Moon ..... 345/212
2003/0117361 A1 * 6/2003 Sono ..... 345/94
2003/0169226 A1 * 9/2003 Yamada ..... 345/102
2003/0169247 A1 * 9/2003 Kawabe et al. ..... 345/204
2003/0222840 A1 * 12/2003 Koga et al. ..... 345/89
2005/0030264 A1 * 2/2005 Tsuge et al. ..... 345/76
2005/0135097 A1 * 6/2005 Kawabata et al. ..... 362/241
2005/0168987 A1 * 8/2005 Tamaoki et al. ..... 362/244
2006/0007211 A1 * 1/2006 Murayama et al. ..... 345/204
2006/0038758 A1 * 2/2006 Routley et al. ..... 345/81

* cited by examiner

*Primary Examiner*—Prabodh Dharia
(74) *Attorney, Agent, or Firm*—Thomas, Kayden, Horstemeyer & Risley

(57) ABSTRACT

A driving circuit for a liquid crystal display. The liquid crystal display panel includes a plurality of light emitting elements and display cells. The display cells are respectively connected to a plurality of data electrodes and gate electrodes. A gate driver outputs scan signals to the gate electrodes. A data driver outputs the video signals to the data electrodes according to the image control signal, and a voltage controlling signal corresponding to a brightness adjustment signal. A driving voltage generator outputs a driving voltage to the light emitting elements according to the voltage controlling signal.

24 Claims, 4 Drawing Sheets

LIQUID CRYSTAL DISPLAY AND DRIVING CIRCUIT THEREOF

BACKGROUND OF THE INVENTION

1. Field of the Invention

The present invention relates in general to a liquid crystal display driving circuit for (LCD) and an LCD panel using the same. In particular, the present invention relates to a driving circuit for driving LCD and its light emitting elements.

2. Description of the Related Art

FIG. 1 is a schematic diagram of a conventional liquid crystal display panel (hereinafter, referred to as an "LCD panel") and the peripheral driving circuits thereof. As shown in the figure, an LCD panel 1 is formed by interlacing data electrodes (represented by D1, D2, D3, . . . , Dm) and gate electrodes (represented by G1, G2, G3, . . . , Gm), each pair of which controls a display cell. As an example, interlacing data electrode D1 and gate electrode G1 control display cell 200. The equivalent circuit of each display cell comprises thin film transistors (TFTs) (Q11-Q1*m*, Q21-Q2*m*, . . . , Qn1-Qnm) and storage capacitors (C11-C1*m*, C21-C2*m*, . . . , Cn1-Cnm). The gates and drains of these TFTs are respectively connected to gate electrodes (G1-Gn) and data electrodes (D1-Dm). Such a connection can turn on or off all TFTs on the same line (i.e. positioned on the same scan line) using a scan signal of gate electrodes (G1-Gn), thereby controlling the video signals of the data electrodes to be written into the corresponding display cell. It is noted that a display cell only controls the brightness of a single pixel on the LCD panel.

Accordingly, each display cell responds to a single pixel on a monochromatic LCD, but to a single subpixel on a color LCD. The subpixel can be red (represented by "R"), blue (represented by "B"), or green (represented by "G"). In other words, a single pixel is formed by an RGB (three display cells) combination.

In addition, FIG. 1 also shows a part of the driving circuit of the LCD panel 1. The gate driver 10 outputs one or more scan signals (also referred to as scan pulses) to each gate electrode G1, G2, . . . , Gn according to a predetermined sequence. When a scan signal is carried on one gate electrode, the TFTs within all display cells on the same row or scan line are turned on while the TFTs within all display cells on other rows or scan lines may be turned off. When a scan line is selected, data driver 20 outputs a video signal (gray value) to the m display cells of the respective rows through data electrodes D1, D2, . . . , Dm according to the image data to be displayed. After gate driver 10 scans n rows continuously, the display of a single frame is completed. Thus, repeated scans of each scan line can achieve continuous display of an image. As shown in FIG. 1, signal CPV indicates the clock of the gate driver 10, signal CTR indicates the scan control signal received by the gate driver 10, signal LD indicates a data latch signal of the data driver 20, and signal DATA indicates the image signal received by the data driver 20.

In addition, conventional LCD panels include light emitting elements providing illumination to enable display function.

U.S. Pat. No. 5,778,256 discloses a personal digital assistant (PDA) comprising a CPU separate from or incorporated into the microcomputer system of the PDA, a memory separate from or incorporated into the microcomputer system, an LED output, LED driver circuitry coupled between the CPU and the LED output, an interface connector, an interface buffer circuit coupled between the interface connector and the CPU, and an interface data buffer circuit coupled by data lines between the interface connector and the CPU. However, the LED driver circuitry only drives LCDs. Thus, the PDA system requires additional space and assembly for LED driver circuitry. Therefore, the cost of the conventional LCD panels is increased.

Moreover, the LED and LCD driver circuitry of conventional Smartphone also operate independently, suffering the same problems mentioned above.

SUMMARY OF THE INVENTION

The object of the present invention is thus to provide a driving circuit for LCD panel integrating the panel driving circuit with the LED driving circuit. Thus, the driving circuit of the LCD panel does not require an additional LED driving circuit, and the cost of the LCD panel is decreased.

To achieve the above-mentioned object, the present invention provides a driving circuit for outputting a video signal to control a liquid crystal display panel according to an image control signal provided by a host. The liquid crystal display panel includes a plurality of light emitting elements and display cells. The display cells are respectively connected to a plurality of data electrodes and gate electrodes. A gate driver outputs scan signals to the gate electrodes. A data driver outputs the video signals to the data electrodes according to the image control signal, and a voltage controlling signal corresponding to a brightness adjustment signal. A driving voltage generator outputs a driving voltage to the light emitting elements according to the voltage controlling signal.

In addition, the present invention provides a driving circuit for outputting a video signal to control a liquid crystal display panel according to an image control signal provided by a host. The liquid crystal display panel includes a plurality of light emitting elements and display cells. The display cells are respectively connected to a plurality of data electrodes and gate electrodes. A gate driver outputs scan signals to the gate electrodes, and a voltage controlling signal corresponding to a brightness adjustment signal. A data driver outputs the video signals to the data electrodes according to the image control signal. A driving voltage generator outputs a driving voltage to the light emitting elements according to the voltage controlling signal.

In addition, the present invention provides a liquid crystal display for displaying images according to an image control signal provided by a host. A liquid crystal display panel comprises a plurality of display cells respectively connected to a plurality of data electrodes and gate electrodes. A panel driver outputs scan signals to the gate electrodes, the video signals to the data electrodes according to the image control signal, and a voltage controlling signal corresponding to a brightness adjustment signal. A driving voltage generator outputs a driving voltage according to the voltage controlling signal. Light emitting elements are connected in serial and coupled to the driving voltage generator, generating brightness corresponding to the driving voltage output by the driving voltage generator.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

First Embodiment

Figure 1:
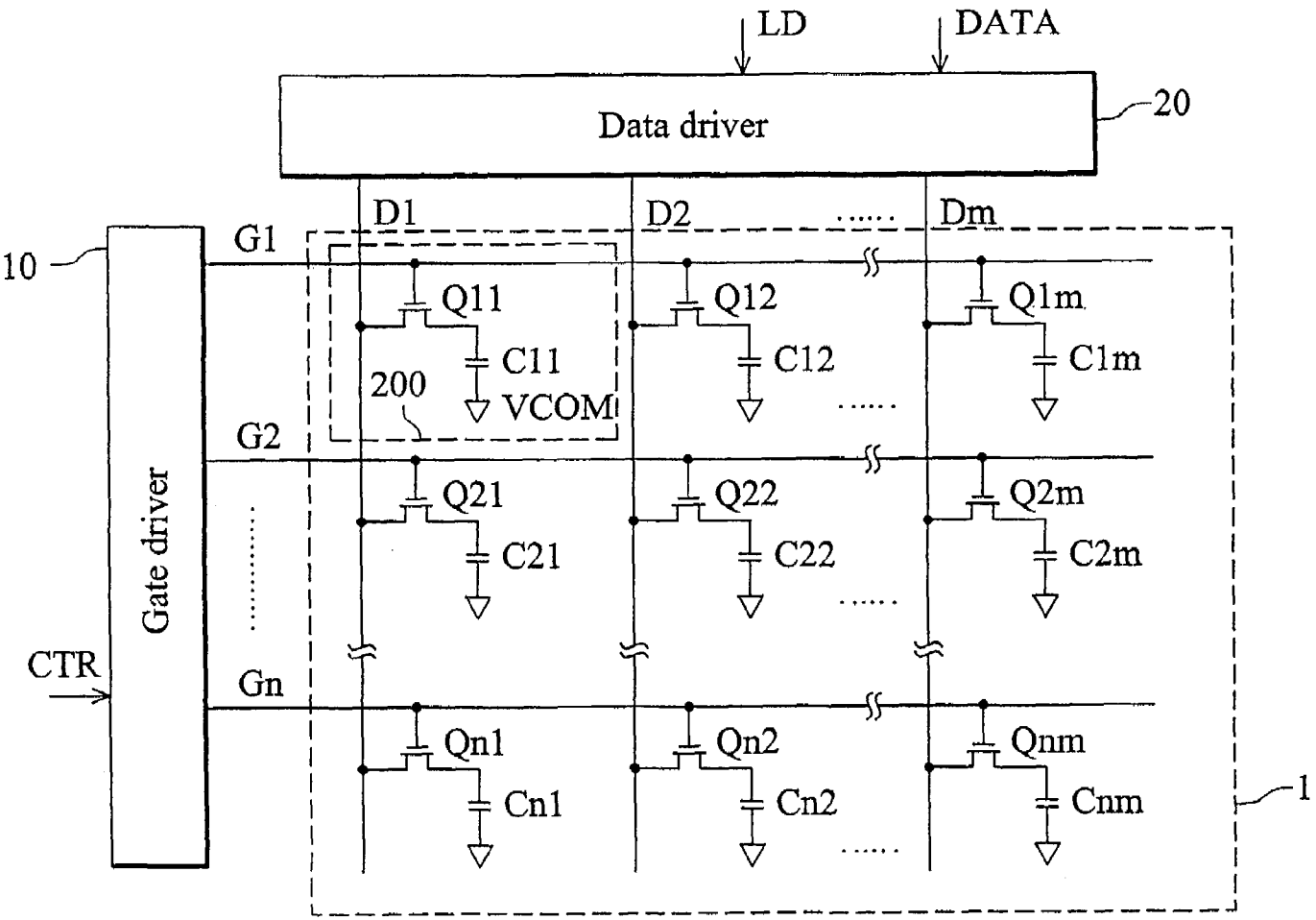
FIG. 1 (PRIOR ART)
FIG. 1 is a schematic diagram of a conventional LCD panel and the peripheral driving circuits thereof.
Figure 2:
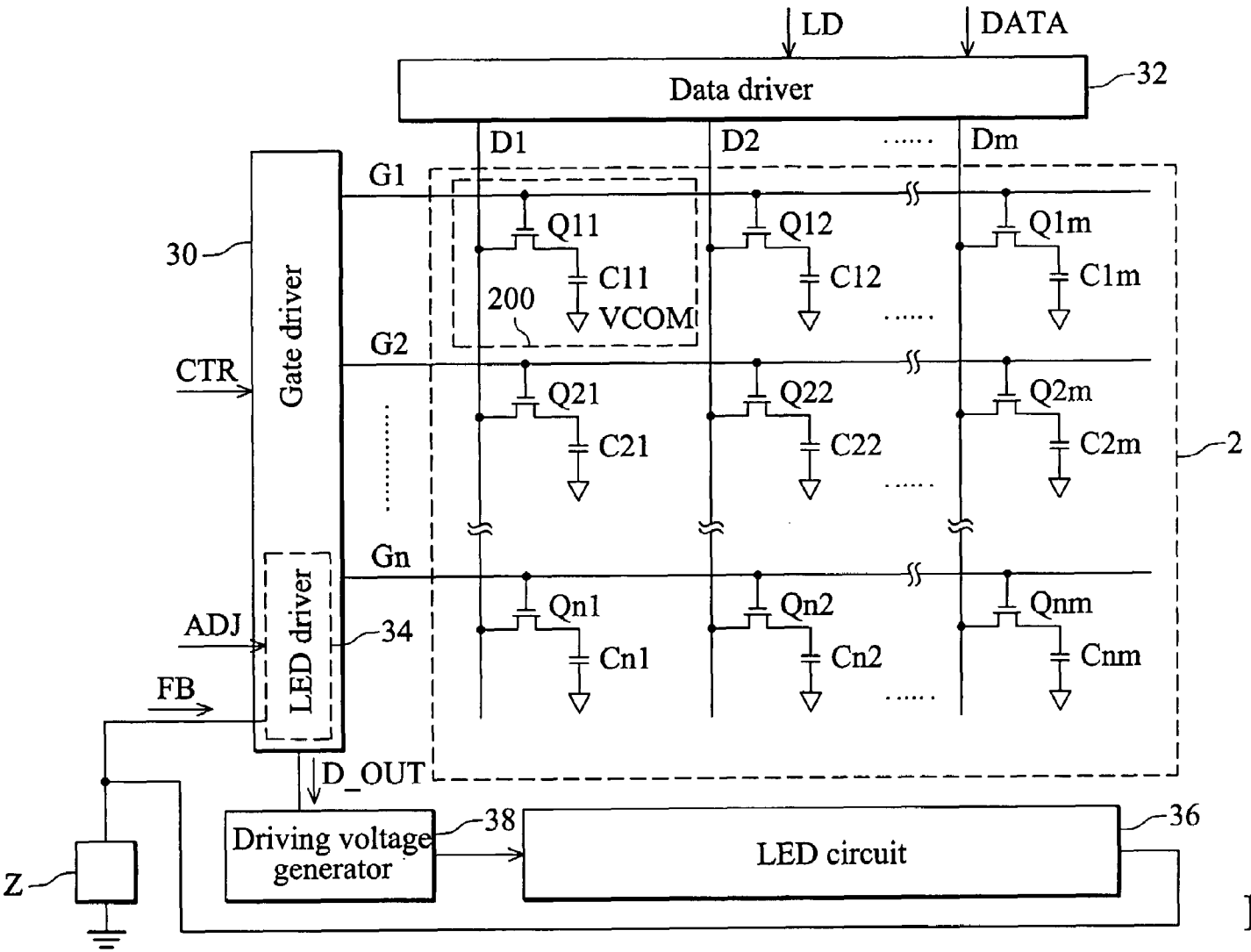
FIG. 2 is a schematic diagram of the LCD panel and the peripheral driving circuits thereof according to the first embodiment of the present invention.

FIG. 2 is a schematic diagram of an LCD panel and the peripheral driving circuits thereof according to the first embodiment of the present invention. As shown in the figure, an LCD panel 2 is formed by interlacing data electrodes (represented by D1, D2, D3, . . . , Dm) and gate electrodes (represented by G1, G2, G3, . . . , Gm), each pair of which controls a display cell. As an example, interlacing data electrode D1 and gate electrode G1 control the display cell 200. The equivalent circuit of each display cell comprises thin film transistors (TFTS) (Q11-Q1*m*, Q21-Q2*m*, . . . , Qn1-Qnm) and storage capacitors (C11-C1*m*, C21-C2*m*, . . . , Cn1-Cnm). The gates and drains of these TFTs are respectively connected to gate electrodes (G1-Gn) and data electrodes (D1-Dm). Such a connection can turn on or off all TFTs on the same line (i.e. positioned on the same scan line) using a scan signal of gate electrodes (G1-Gn), thereby driving the video signals of the data electrodes to be written into the corresponding display cell. It is noted that a display cell only controls the brightness of a single pixel on the LCD panel.

Accordingly, each display cell responds to a single pixel on a monochromatic LCD but to a single subpixel on a color LCD. The subpixel can be red (represented by "R"), blue (represented by "B"), or green (represented by "G"). In other words, a single pixel is formed by an RGB (three display cells) combination.

In addition, FIG. 2 also shows a part of the driving circuit of the LCD panel 2. The gate driver 30 outputs one or more scan signals (also referred to as scan pulses) to each gate electrode G1, G2, . . . , Gn according to a predetermined sequence. When a scan signal is carried on one gate electrode, the TFTs within all display cells on the same row or scan line are turned on while the TFTs within all display cells on other rows or scan lines may be turned off. When a scan line is selected, data driver 32 outputs a video signal (gray value) to the m display cells of the respective rows through data electrodes D1, D2, . . . , Dm according to the image data to be displayed. In addition, the gate driver 30 further comprises an LED driver 34, which outputs an voltage control signal D_out according to a feedback signal FB output from the LED circuit 36 and a brightness adjustment signal ADJ.

Figure 3:
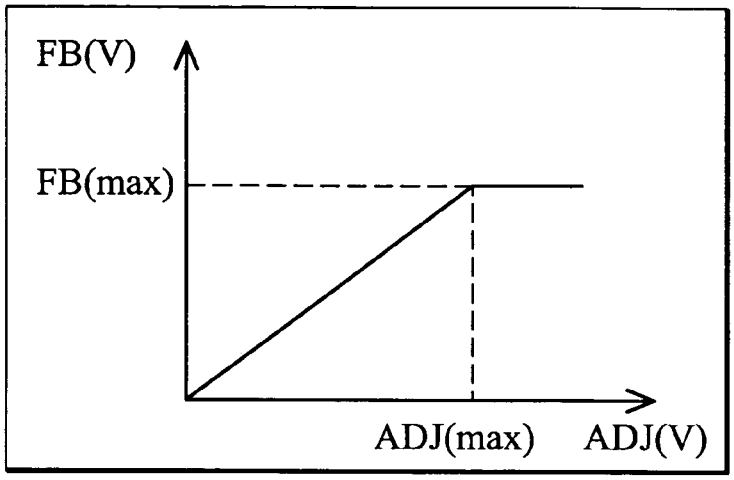
FIG. 3 shows the relationship between the brightness adjustment signal ADJ and the feedback signal FB.

FIG. 3 shows the relationship between the brightness adjustment signal ADJ and the feedback signal FB. Before the voltage level of the brightness adjustment signal ADJ reaches a voltage ADJ(max), the voltage level of the feedback signal FB output from the LED circuit 36 increases with the increase in the brightness adjustment signal ADJ. Thus, the brightness of the LED is adjusted according to the voltage level of the brightness adjustment signal ADJ. When the voltage level of the brightness adjustment signal ADJ reaches the voltage ADJ(max), the voltage level of the feedback signal FB also reaches FB(max). If the voltage level of the brightness adjustment signal ADJ increases, the voltage level of the feedback signal FB stays at the voltage FB (max) to prevent the circuit from burnout. Here, the brightness adjustment signal ADJ with voltage ADJ (max) generates the default maximum brightness of the LCD panel.

Figure 4:
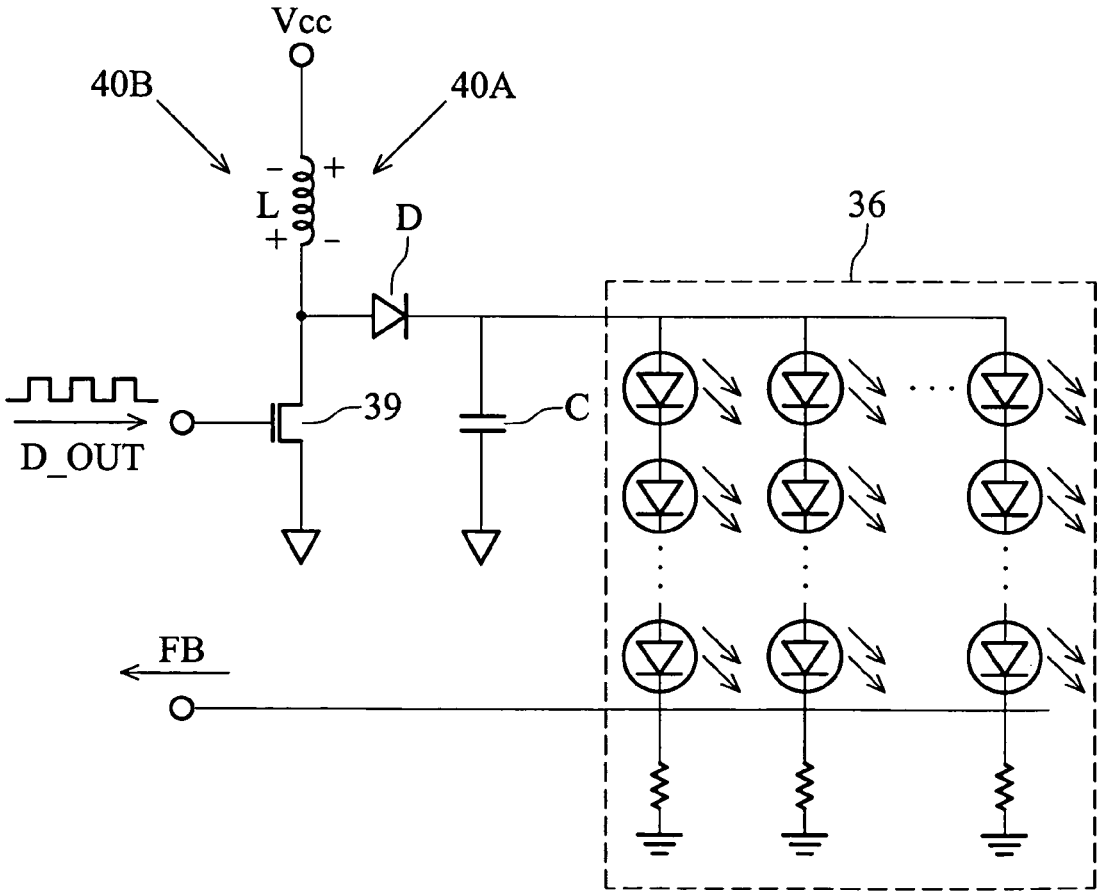
FIG. 4 shows a circuit of the driving voltage generator 38 and LED circuit.

Driving voltage generator 38 outputs the driving voltage corresponding to the voltage control signal D_out output from the LED driver 34 to the LED circuit 36. Here, the waveform of the voltage control signal D_out comprises a plurality of square waves. FIG. 4 shows a circuit of the driving voltage generator 38 and LED circuit. Switch 39 is an NMOS transistor in the present embodiment, comprising a control gate. The inductor L is connected between the drain of the NMOS transistor and a power source Vcc. The anode of the diode D is connected to the connection point of the inductor L and the NMOS transistor. The capacitor C is connected between the cathode of the diode D and ground, and the connection point of the capacitor C and the diode D is a voltage output terminal Vo outputting direct current (DC) with a predetermined voltage level. The DC power output from the voltage output terminal Vo is provided to the LED circuit 36. The LED circuit 36 comprises a plurality of LEDs connected in serial and in parallel. In the present embodiment, the LED circuit 36 may comprise a plurality of LEDs connected in serial, parallel, or a combination of both.

The operation of the driving voltage generator 38 is described as follows. Current flows to ground through inductor L and the NMOS transistor when the switch 39 is turned on. Thus, electromotive force is generated on both sides of the inductor L, wherein the polarity of the electromotive force is labeled 40A. At this time, output voltage of the driving voltage generator 38 decreases because of the current leakage of the capacitor C. The polarity of the electromotive force of the inductor L is reversed when the switch 38 is turned off, wherein label 40B denotes the polarity of the electromotive force. Thus, current charges the capacitor C through the inductor L and the diode D, such that the output voltage of the driving voltage generator 38 is increased. Because the switching of the NMOS transistor 39 is controlled by the voltage control signal D_out, the output voltage of the driving voltage generator 38 is adjusted by adjusting the ratio between the periods of the high voltage level and the low voltage level of the voltage control signal D_out by the LED driver 34. For example, the driving voltage is raised by increasing the percentage of period of the low voltage level of the voltage control signal D_out, and the driving voltage is lowered by increasing the percentage of period of the high voltage level of the voltage control signal D_out.

In addition, an appropriate brightness is obtained when the LED circuit 36 receives the driving voltage output from the driving voltage generator 38. The feedback voltage FB of the connection point of the LED circuit 36 and the resistive load Z is fed back to the LED driver 34. As mentioned above, when the voltage level of the feedback voltage FB is too low, in other words, deviates from the relationship shown in FIG. 3, the percentage of period of the low voltage level of the voltage control signal D_out is increased to raise the voltage of the driving voltage output by the driving voltage generator 38. Thus, the voltage level of the feedback voltage FB is raised to an expected level. On the contrary, when the voltage level of the feedback voltage FB is too high, the percentage of period of the high voltage level of the voltage control signal D_out is increased to lower the voltage of the driving voltage output by the driving voltage generator 38. Thus, the voltage level of the feedback voltage FB is lowered to the expected level.

Second Embodiment

Figure 5:
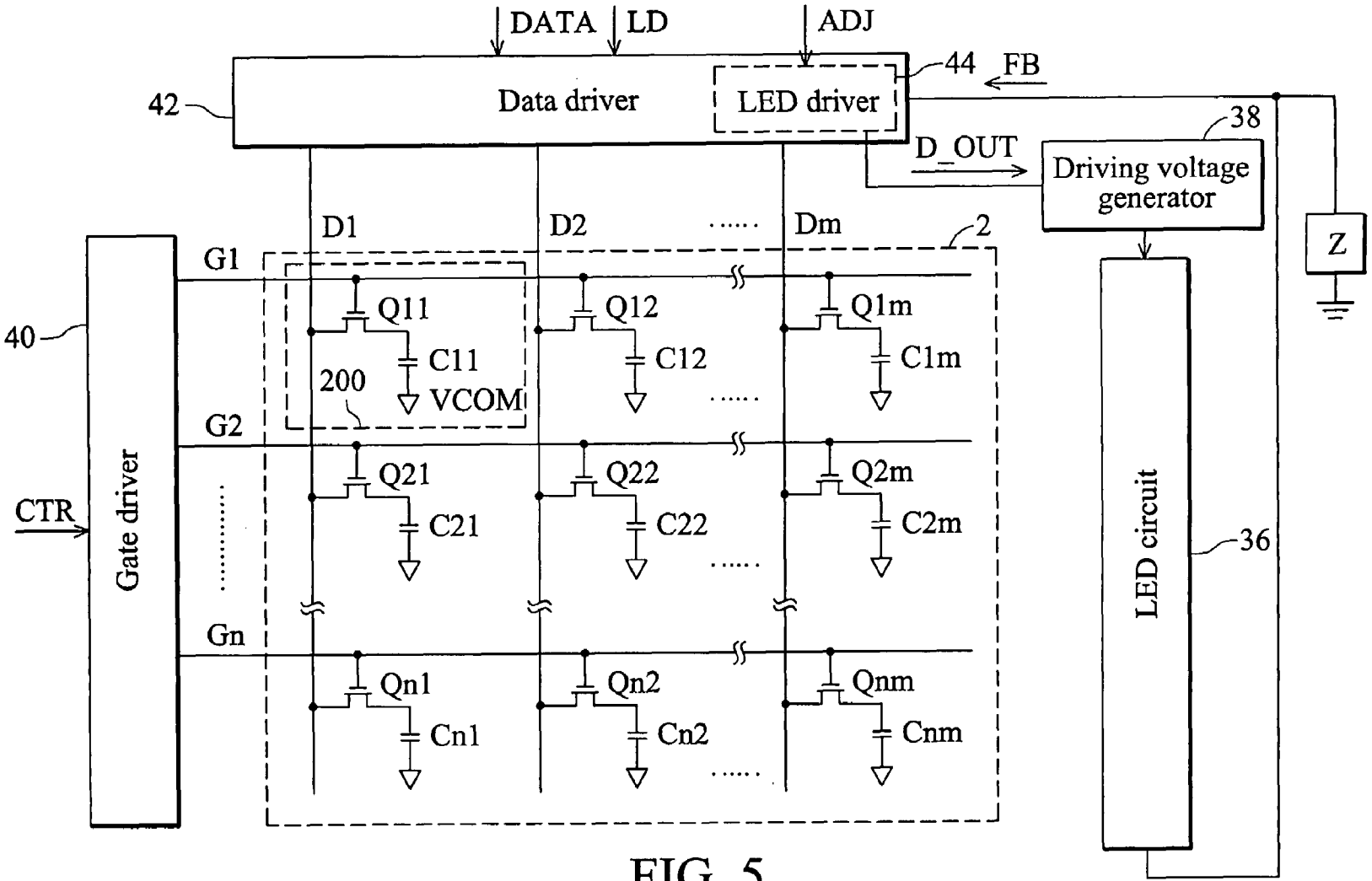
FIG. 5 is a schematic diagram of the LCD panel and the peripheral driving circuits thereof according to the second embodiment of the present invention.

FIG. 5 is a schematic diagram of an LCD panel and the peripheral driving circuits thereof according to the second embodiment of the present invention. As shown in the figure, an LCD panel 2 is formed by interlacing data electrodes (represented by D1, D2, D3, . . . , Dm) and gate electrodes (represented by G1, G2, G3, . . . , Gm), each pair of which controls a display cell. As an example, interlacing data electrode D1 and gate electrode G1 control the display cell 200. The equivalent circuit of each display cell comprises thin film transistors (TFTs) (Q11-Q1*m*, Q21-Q2*m*, . . . , Qn1-Qnm) and storage capacitors (C11-C1*m*, C21-C2*m*, . . . , Cn1-Cnm). The gates and drains of these TFTs are respectively connected to gate electrodes (G1-Gn) and data electrodes (D1-Dm). Such a connection can turn on or off all TFTs on the same line (i.e. positioned on the same scan line) using a scan signal of gate electrodes (G1-Gn), thereby controlling the video signals of the data electrodes to be written into the corresponding display cell.

In addition, FIG. 5 also shows a part of the driving circuit of the LCD panel 2. The gate driver 40 outputs one or more scan signals (also referred to as scan pulses) to each gate electrode G1, G2, . . . , Gn according to a predetermined sequence. When a scan signal is carried on one gate electrode, the TFTs within all display cells on the same row or scan line are turned on while the TFTs within all display cells on other rows or scan lines may be turned off. When a scan line is selected, data driver 42 outputs a video signal (gray value) to the m display cells of the respective rows through data electrodes D1, D2, . . . , Dm according to the image data to be displayed. In addition, the data driver 42 further comprises an LED driver 44, which outputs an voltage control signal D_out according to a feedback signal FB output from the LED circuit 36 and a brightness adjustment signal ADJ.

FIG. 3 shows the relationship between the brightness adjustment signal ADJ and the feedback signal FB. Before the voltage level of the brightness adjustment signal ADJ reaches a voltage ADJ(max), the voltage level of the feedback signal FB output from the LED circuit 36 increases with the increase in the brightness adjustment signal ADJ. Thus, the brightness of the LED is adjusted according to the voltage level of the brightness adjustment signal ADJ. When the voltage level of the brightness adjustment signal ADJ reaches the voltage ADJ (max), the voltage level of the feedback signal FB also reaches FB(max). If the voltage level of the brightness adjustment signal ADJ increases now, the voltage level of the feedback signal FB stays at the voltage FB(max) to prevent the circuit from burnout. Here, the brightness adjustment signal ADJ with voltage ADJ (max) generates the default maximum brightness of the LCD panel.

Here, the brightness adjustment signal ADJ is adjusted by adjusting a variable resistor connected to a predetermined voltage, or an extra circuit. In addition, when the voltage level of the feedback voltage FB fed back from the LED circuit 36 is too low, in other words, deviates from the relationship shown in FIG. 3, the driving voltage generator 38 outputs a higher voltage level according to the voltage control signal D_out output from the LED driver 44 to make the voltage level of the feedback voltage FB of the LED circuit 36 reach a predetermined level.

Driving voltage generator 38 outputs the driving voltage corresponding to the voltage control signal D_out output from the LED driver 44 to the LED circuit 36. Here, the waveform of the voltage control signal D_out comprises a plurality of square waves. In FIG. 4, the switch 39 is an NMOS transistor in the present embodiment, comprising a control gate. The inductor L is connected between the drain of the NMOS transistor and a power source Vcc. The anode of the diode D is connected to the connection point of the inductor L and the NMOS transistor. The capacitor C is connected between the cathode of the diode D and ground, and the connection point of the capacitor C and the diode D is a voltage output terminal Vo for outputting direct current (DC) with a predetermined voltage level.

The DC power output from the voltage output terminal Vo is provided to the LED circuit 36. The LED circuit 36 comprises a plurality of LEDs connected in serial and parallel. In the present embodiment, the LED circuit 36 may comprise a plurality of LEDs connected in serial, parallel, or a combination of both.

The operation of the driving voltage generator 38 is described as follows. Current flows to ground through inductor L and the NMOS transistor when the switch 39 is turned on. Thus, electromotive force is generated on both sides of the inductor L, wherein the polarity of the electromotive force is labeled 40A. At this time, output voltage of the driving voltage generator 38 decreases because of the current leakage of the capacitor C. The polarity of the electromotive force of the inductor L is reversed when the switch 38 is turned off, wherein label 40B denotes the polarity of the electromotive force. Thus, current charges the capacitor C through the inductor L and the diode D, such that the output voltage of the driving voltage generator 38 is increased. Because the switching of the NMOS transistor 39 is controlled by the voltage control signal D_out, the output voltage of the driving voltage generator 38 is adjusted by adjusting the ratio between the periods of the high voltage level and the low voltage level of the voltage control signal D_out by the LED driver 44. For example, the driving voltage is raised by increasing the percentage of period of the low voltage level of the voltage control signal D_out, and the driving voltage is lowered by increasing the percentage of period of the high voltage level of the voltage control signal D_out.

In addition, an appropriate brightness is obtained when the LED circuit 36 receives the driving voltage output from the driving voltage generator 38. The feedback voltage FB of the connection point of the LED circuit 36 and the resistive load Z is fed back to the LED driver 44. As mentioned above, when the voltage level of the feedback voltage FB is too low, in other words, deviates from the relationship shown in FIG. 3, the percentage of period of the low voltage level of the voltage control signal D_out is increased to raise the voltage of the driving voltage output by the driving voltage generator 38. Thus, the voltage level of the feedback voltage FB is raised to an expected level. On the contrary, when the voltage level of the feedback voltage FB is too high, the percentage of period of the high voltage level of the voltage control signal D_out is increased to lower the voltage of the driving voltage output by the driving voltage generator 38. Thus, the voltage level of the feedback voltage FB is lowered to the expected level.

According to the first and second embodiments of the present invention, the LED driver is integrated with the data driver or gate driver of the LCD panel. Thus, the driving circuit of LCD panel does not require an additional LED driving circuit, and the cost of the LCD panel is decreased. In addition, the LCD panel according to the embodiments of the present invention can be applied to any size, especially small-size panels used in PDA, telephone, and smartphone.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A driving circuit for outputting a video signal to control a liquid crystal display panel according to an image control signal provided by a host, the liquid crystal display panel including a plurality of light emitting elements and display cells, the display cells respectively connecting to a plurality of data electrodes and gate electrodes, the driving circuit comprising:

a gate driver outputting scan signals to the gate electrodes;

a data driver outputting the video signals to the data electrodes according to the image control signal, and a voltage controlling signal corresponding to a brightness adjustment signal; and a driving voltage generator outputting a driving voltage to the light emitting elements according to the voltage controlling signal.

2. The driving circuit as claimed in claim 1, wherein the voltage controlling signal comprises a plurality of square waves having periods of high voltage level and low voltage level.

3. The driving circuit as claimed in claim 1, wherein the data driver adjusts the ratio between the periods of the high voltage level and the low voltage level according to the brightness adjustment signal.

4. The driving circuit as claimed in claim 3, wherein the driving voltage generator comprises:

a switch having a control gate receiving the voltage controlling signal and turned on or off according to the voltage level of the voltage controlling signal;

an inductor coupled between the switch and a power source;

a diode coupled between the switch and the inductor; and a capacitor coupled to the diode, wherein the connection point of the capacitor and the diode outputs the driving voltage.

5. The driving circuit as claimed in claim 4, wherein the level of the driving voltage is generated according to the ratio between the periods of the high voltage level and the low voltage level.

6. The driving circuit as claimed in claim 1, wherein the light emitting elements comprise a plurality of LEDs connected in serial, parallel, or a combination of both, and a first terminal coupled to the driving voltage generator and a second terminal coupled to the data driver.

7. The driving circuit as claimed in claim 6, wherein the data driver adjusts the ratio between the periods of the high voltage level and the low voltage level of the voltage controlling signal according to the voltage level of the second terminal.

8. The driving circuit as claimed in claim 6, further comprising a load coupled between the second terminal and ground.

9. A driving circuit for outputting a video signal to control a liquid crystal display panel according to an image control signal provided by a host, the liquid crystal display panel including a plurality of light emitting elements and display cells, the display cells respectively connecting to a plurality of data electrodes and gate electrodes, the driving circuit comprising:

a gate driver outputting scan signals to the gate electrodes, and a voltage controlling signal corresponding to a brightness adjustment signal;

a data driver outputting the video signals to the data electrodes according to the image control signal; and a driving voltage generator outputting a driving voltage to the light emitting elements according to the voltage controlling signal.

10. The driving circuit as claimed in claim 9, wherein the voltage controlling signal comprises a plurality of square waves having periods of a high voltage level and a low voltage level.

11. The driving circuit as claimed in claim 9, wherein the gate driver adjusts the ratio between the periods of the high voltage level and the low voltage level according to the brightness adjustment signal.

12. The driving circuit as claimed in claim 11, wherein the driving voltage generator comprises:

a switch having a control gate receiving the voltage controlling signal and turned on or off according to voltage level of the voltage controlling signal;

an inductor coupled between the switch and a power source;

a diode coupled between the switch and the inductor; and a capacitor coupled to the diode, wherein the connection point of the capacitor and the diode outputs the driving voltage.

13. The driving circuit as claimed in claim 12, wherein the level of the driving voltage is generated according to the ratio between the periods of the high voltage level and the low voltage level.

14. The driving circuit as claimed in claim 9, wherein the light emitting elements comprise a plurality of LEDs connected in serial, parallel, or a combination of both, and a first terminal coupled to the driving voltage generator and a second terminal coupled to the data driver.

15. The driving circuit as claimed in claim 14, wherein the data driver adjusts the ratio between the periods of the high voltage level and the low voltage level of the voltage controlling signal according to the voltage level of the second terminal.

16. The driving circuit as claimed in claim 14, further comprising a load coupled between the second terminal and ground.

17. A liquid crystal display for displaying images according to an image control signal provided by a host, comprising:

a liquid crystal display panel comprising a plurality of display cells respectively connected to a plurality of data electrodes and gate electrodes;

a panel driver outputting scan signals to the gate electrodes, the video signals to the data electrodes according to the image control signal, and a voltage controlling signal corresponding to a brightness adjustment signal;

a driving voltage generator outputting a driving voltage according to the voltage controlling signal; and a plurality of light emitting elements connected in serial and coupled to the driving voltage generator generating brightness corresponding to the driving voltage output by the driving voltage generator.

18. The liquid crystal display as claimed in claim 17, wherein the voltage controlling signal comprises a plurality of square waves having periods of a high voltage level and a low voltage level.

19. The liquid crystal display as claimed in claim 17, wherein the panel driver adjusts the ratio between the periods of the high voltage level and the low voltage level according to the brightness adjustment signal.

20. The liquid crystal display as claimed in claim 17, wherein the driving voltage generator comprises:

a switch having a control gate for receiving the voltage controlling signal and turned on or off according to voltage level of the voltage controlling signal;

an inductor coupled between the switch and a power source;

a diode coupled between the switch and the inductor; and a capacitor coupled to the diode, wherein the connection point of the capacitor and the diode outputs the driving voltage.

21. The liquid crystal display as claimed in claim 20, wherein the level of the driving voltage is generated according to the ratio between the periods of the high voltage level and the low voltage level.

22. The liquid crystal display as claimed in claim 17, wherein the light emitting elements comprise a plurality of LEDs connected in serial, parallel, or a combination of both, and a first terminal coupled to the driving voltage generator and a second terminal coupled to the panel driver.

23. The liquid crystal display as claimed in claim 22, wherein the panel driver adjusts the ratio between the periods of the high voltage level and the low voltage level of the voltage controlling signal according to the voltage level of the second terminal.

24. The liquid crystal display as claimed in claim 23, further comprising a load coupled between the second terminal and ground.

* * * * *